US009378708B2

(12) United States Patent
Lee et al.

(10) Patent No.: US 9,378,708 B2
(45) Date of Patent: Jun. 28, 2016

(54) DRIVING DEVICE, DISPLAY DEVICE INCLUDING THE DRIVING DEVICE, AND DRIVING METHOD OF THE DISPLAY DEVICE

(71) Applicant: SAMSUNG DISPLAY CO., LTD., Yongin, Gyeonggi-Do (KR)

(72) Inventors: Jung-Sun Lee, Yongin (KR); Young-Joo Lee, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 434 days.

(21) Appl. No.: 14/061,204

(22) Filed: Oct. 23, 2013

(65) Prior Publication Data

US 2014/0240380 A1 Aug. 28, 2014

(30) Foreign Application Priority Data

Feb. 28, 2013 (KR) ..... 10-2013-0022380

(51) Int. Cl.
*G09G 5/10* (2006.01)

(52) U.S. Cl.
CPC ..... *G09G 5/10* (2013.01)

(58) Field of Classification Search
CPC ..... G09G 3/3696; G09G 2330/02–2330/028; G09G 5/10; G09G 2310/027; G09G 2310/0272
USPC ..... 345/211–213, 691
See application file for complete search history.

(56) References Cited

U.S. PATENT DOCUMENTS

2010/0201698 A1* 8/2010 Lee ..... G09G 3/20 345/536
2011/0025673 A1* 2/2011 Chen ..... H02M 3/156 345/211

FOREIGN PATENT DOCUMENTS

KR 10-2006-0064129 A 6/2006
KR 10-2009-0052666 A 5/2009
KR 10-2009-0053393 A 5/2009
KR 10-2011-0013806 A 2/2011

* cited by examiner

*Primary Examiner* — Michael Pervan
*Assistant Examiner* — Andrew Lee
(74) *Attorney, Agent, or Firm* — Lee & Morse, P.C.

(57) ABSTRACT

A driving device includes a memory configured to store an initial setting value to drive a display, a power source controller configured to output a pulse width modulation (PWM) signal controlling power applied to the display, and a switching unit configured to connect an input and output port to the memory when writing data to a memory and configured to connect the power source controller to the input and output port when driving the display.

16 Claims, 6 Drawing Sheets

DRIVING DEVICE, DISPLAY DEVICE INCLUDING THE DRIVING DEVICE, AND DRIVING METHOD OF THE DISPLAY DEVICE

CROSS-REFERENCE TO RELATED APPLICATION

This application claims priority to and the benefit of Korean Patent Application No. 10-2013-0022380 filed in the Korean Intellectual Property Office on Feb. 28, 2013, the entire contents of which are incorporated herein by reference.

BACKGROUND

1. Field

Embodiments relate to a driving device, a display device including the same, and a driving method thereof.

2. Description of the Related Art

In operation of a display device, a deviation may be generated between display luminance according to an actual display luminance and grayscale data of the display device. Compensation of such a deviation may enhance an image displayed on the display device.

The above information disclosed in this Background section is only for enhancement of understanding of the background of the invention and therefore it may contain information that does not form the prior art that is already known in this country to a person of ordinary skill in the art.

SUMMARY

Embodiments are directed to a driving device, including a memory configured to store an initial setting value to drive a display, a power source controller configured to output a pulse width modulation (PWM) signal controlling power applied to the display, and a switching unit configured to connect an input and output port to the memory when writing data to a memory and configured to connect the power source controller to the input and output port when driving the display.

The switching unit may be configured to connect the memory and the power source controller to the input and output port through one wire.

The driving device may further include a connection controller configured to control the switching unit, and the connection controller may be configured to provide the initial setting value to the memory when writing the data to the memory and provide the PWM signal to the power source controller when driving the display.

The memory may be configured to fix the initial setting value written thereto by using a voltage applied from the switching unit after writing the initial setting value provided from the connection controller.

The power source controller may be configured to output the PWM signal provided from the connection controller to the input and output port through the switching unit.

The PWM signal output by the power source controller may control an ELVSS voltage.

Embodiments are also directed to a display device including a driving device according to an embodiment.

Embodiments are also directed to a display device, including a driving device including a memory configured to store an initial setting value to drive a display and a power source controller configured to output a pulse width modulation (PWM) signal controlling a power source voltage supplied to the display, and a switching unit configured to connect an input and output port to the memory when writing data to a memory and connect the power source controller to the input and output port when driving the display.

The driving device may further include a connection controller configured to control the switching unit according to an operation state of writing the data to the memory and driving the display.

The switching unit may include a first switching transistor configured to connect to the memory and configured to apply an MTPHV voltage to the memory, and a second switching transistor configured to connect to the power source controller and output the PWM signal of the power source controller to control a DC-DC converter.

The connection controller may be configured to apply a VGL voltage ON to a gate of the first switching transistor, apply the MTPHV voltage to the memory, and apply a VGH voltage OFF to a gate of the second switching transistor when writing the data to the memory.

The connection controller may be configured to apply the VGH voltage OFF to the gate of the first switching transistor and apply the VGL voltage ON to the gate of the second switching transistor to output the PWM signal of the power source controller to the input and output port when driving the display.

Embodiments are also directed to a method of driving a display device by a driving device, the method including a controlling operation of outputting a control signal according to an operation state of writing data to a memory and driving a display, a switching operation of connecting a memory or a power source controller to an input and output port by a switching unit according to a control signal, and a driving operation of applying a voltage to the memory or outputting a signal of the power source controller to the input and output port according to the switching operation.

In the driving operation, if the memory is connected to the input and output port, an MTPHV voltage may be applied to the memory to fix an initial setting value that is written to the memory.

In the driving operation, if the power source controller is connected to the input and output port, a PWM signal controlling a DC-DC converter may be output to the input and output port.

In the driving operation, the MTPHV voltage may be applied to the memory or the PWM signal of the power source controller is output through one wire.

BRIEF DESCRIPTION OF THE DRAWINGS

Features will become apparent to those of skill in the art by describing in detail example embodiments with reference to the attached drawings in which.

DETAILED DESCRIPTION

Figure 1:
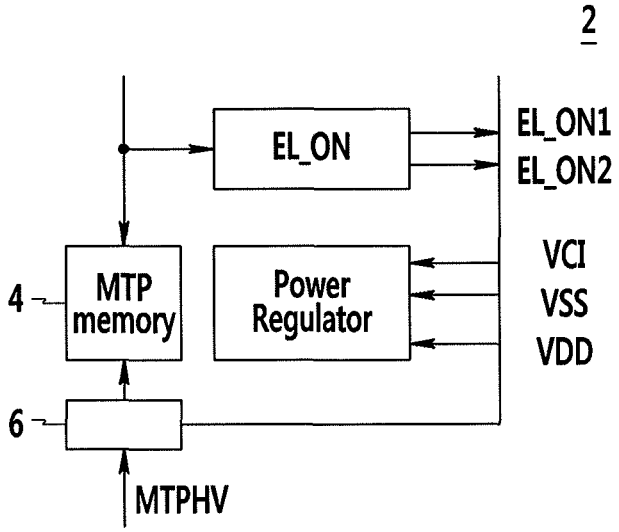
FIG. 1 is a view of a portion of a general driving integrated circuit.

In the following detailed description, only certain example embodiments have been shown and described, simply by way of illustration. As those skilled in the art would realize, the described embodiments may be modified in various different ways, all without departing from the spirit or scope. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a view of a portion of a general driving integrated circuit.

Multi-time programming (hereafter referred to as "MTP") may be used to compensate a reference gamma voltage to remove a deviation generated between display luminance according to an actual display luminance and grayscale data of the display device. For this, grayscale data information according to a video signal may be stored to an MTP memory. The grayscale data information is information determining a data voltage supplied to a corresponding pixel.

FIG. 1 is a view showing a structure for applying an MTPHV voltage to a driving integrated circuit from the outside for the MTP. For this, six pins are allocated to separately apply the MTPHV voltage to an MTP memory 4.

Here, the MTPHV voltage is a signal that is only operated when deleting or writing the data to the MTP memory 4 and is in a floating state during non-operation such that the wire applying the MTPHV voltage may influence EMI, and an FPC area and a separate pin for a connector are allocated to apply the MTPHV voltage.

Also, an ESD protection circuit for the MTPHV voltage signal may be separately formed on the driving integrated circuit and the FPC.

Figure 2:
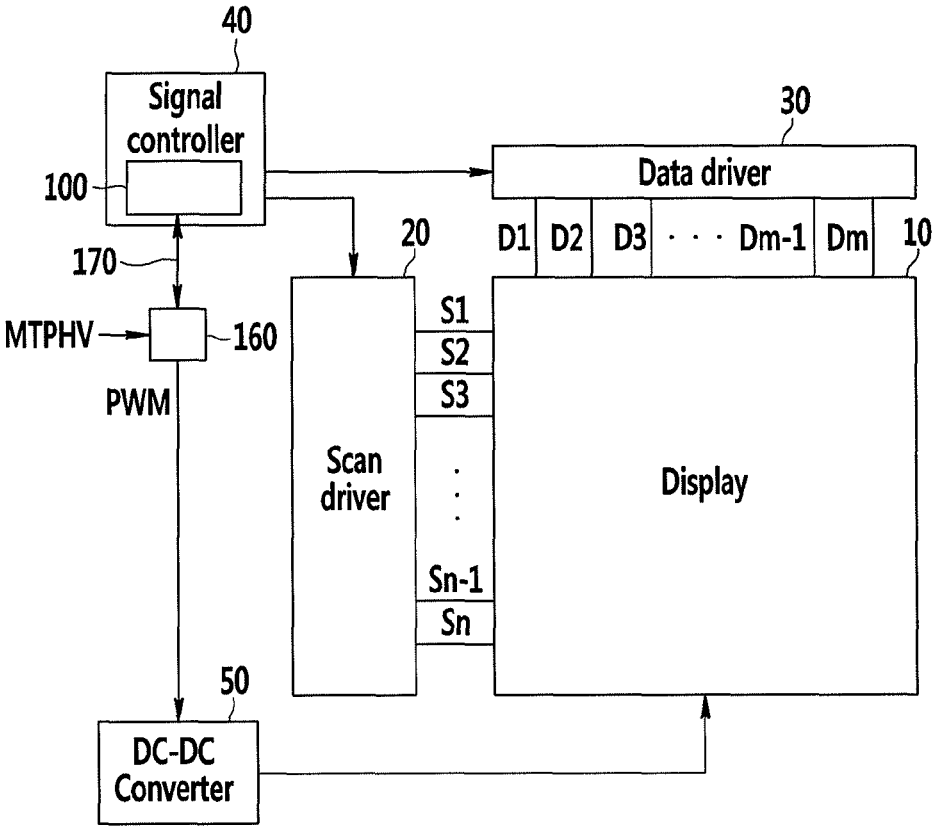
FIG. 2 is a view of a display device including a driving device according to an example embodiment.

FIG. 2 is a view of a display device including a driving device according to an example embodiment.

Referring to FIG. 2, a display device includes a display unit 10, a scan driver 20, a data driver 30, a signal controller 40, a DC-DC converter 50, and an input and output port 160.

The display unit 10 includes a plurality of scan lines S1-Sn, a plurality of data lines D1-Dm, and a plurality of pixels connected to the plurality of signal lines S1-Sn and D1-Dm and arranged in an approximate matrix. The plurality of scan lines S1-Sn extend in an approximate row direction and approximately parallel to each other. The plurality of data lines D1-Dm extend in an approximate column direction and approximately parallel to each other.

The scan driver 20 is connected to the plurality of scan lines S1-Sn and generates a plurality of scan signals according to a first driving control signal. The scan driver 20 sequentially applies the scan signals of a gate-on voltage to the plurality of scan lines S1-Sn.

The data driver 30 is connected to the plurality of data lines D1-Dm, samples and holds the image data signal DAT according to a second driving control signal, and applies a plurality of data signals to the plurality of data lines D1-Dm. The data driver 300 applies the data signal having a predetermined voltage range to the plurality of data lines D1-Dm by corresponding to the scan signals of the gate-on voltage to write the data to the plurality of pixels.

The signal controller 40 receives video signals R, G, and B, and a synchronization signal that are input from the outside. The video signals R, G, and B include luminance information of each pixel PX, and the luminance has a grayscale having a predetermined number, for example $1024=2^{10}$, $256=2^{8}$, or $64=2^{6}$. For example, the input control signals may include a vertical synchronization signal Vsync, a horizontal synchronization signal Hsync, a main clock signal MCLK, and a data enable signal DE.

The signal controller 40 divides the video signals R, G, and B by a frame unit according to the vertical synchronization signal Vsync, and divides the video signals R, G, and B by a scan line unit according to the horizontal synchronization signal Hsync to generate the image data signal DAT. The signal controller 40 transmits the image data signal DAT along with the first driving control signal to the data driver 30.

Also, the signal controller 40 includes a driving device 100. The driving device 100 receives an MTPHV voltage to fix a data written to the memory and provides a PWM signal controlling a power source voltage supplied to the display using the DC-DC converter 50.

According to the present example embodiment, an MTPHV voltage is applied or a PWM signal is provided through one wire 170 between the driving device 100 of the signal controller 40 and the input and output port 160.

The DC-DC converter 50 receives a PWM signal from the signal controller 40 and applies power source voltages ELVDD and ELVSS to the display unit 10 for the driving.

Figure 3:
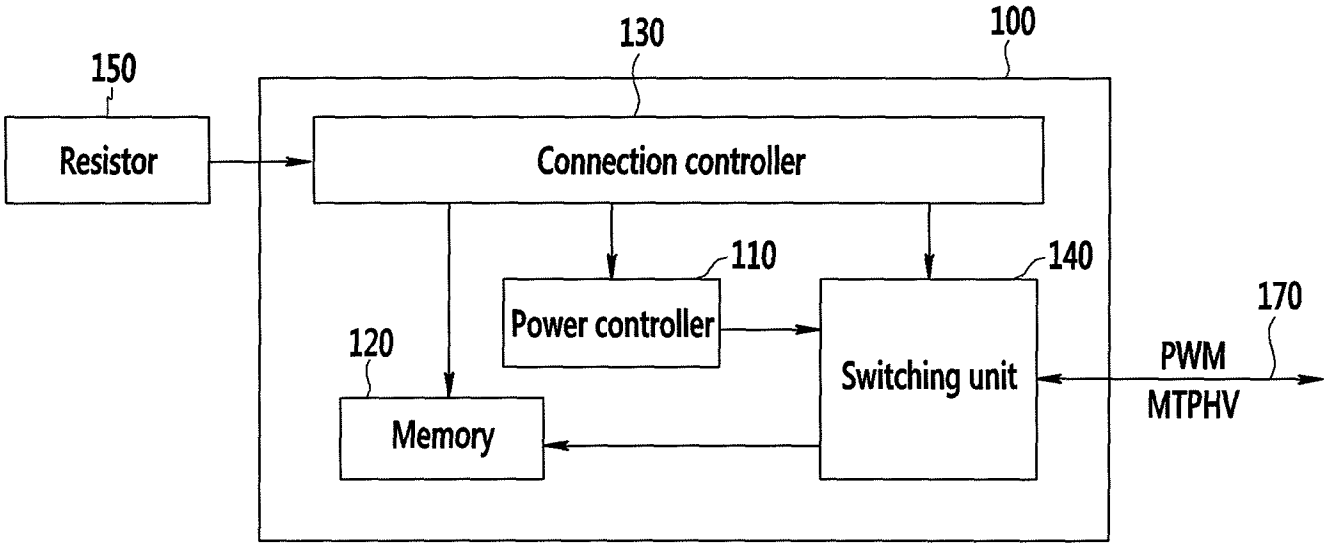
FIG. 3 is a block diagram of a driving device according to an example embodiment.

FIG. 3 is a block diagram of a driving device according to an example embodiment.

The driving device 100 outputs a control signal controlling the display unit 10, and includes a pin for the input and output of various signals. The driving device 100 may output the control signal through an output pin for the control signal.

Referring to FIG. 2, the driving device 100 includes a power source controller 110, a memory 120, a connection controller 130, and a switching unit 140.

The power source controller 110 outputs a PWM signal controlling the DC-DC converter 50. The DC-DC converter is provided outside the display unit 10 and applies the power source voltages ELVDD and ELVSS to the display unit 10.

Figure 4:
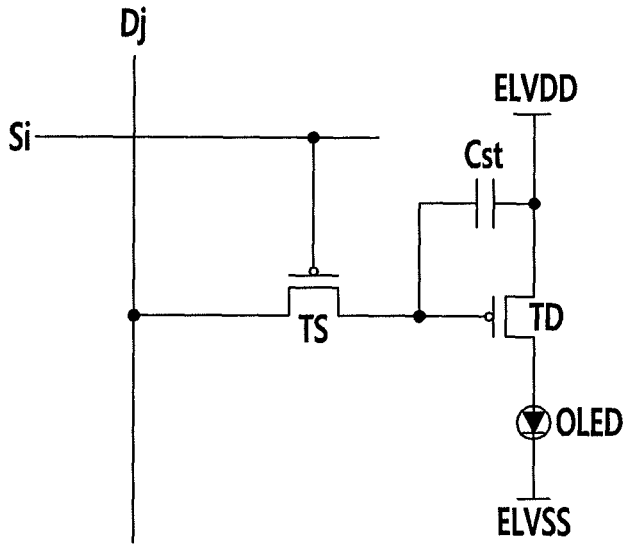
FIG. 4 is a circuit diagram showing a structure of a display device pixel.

FIG. 4 is a circuit diagram of a structure of a pixel of a display unit. An example embodiment is not limited thereto.

The pixel shown in FIG. 4 is connected to the i-th scan line Si and the j-th data line Dj.

As shown in FIG. 4, the pixel includes a switching transistor TS, a driving transistor TD, a capacitor Cst, and an organic light emitting element OLED.

The switching transistor TS includes a gate electrode connected to the scan line Si, a first electrode connected to the data line Dj, and a second electrode connected to the gate electrode of the driving transistor TD.

The driving transistor TD includes the source electrode connected to the voltage ELVDD, the drain electrode connected to an anode of the organic light emitting element (OLED), and the gate electrode connected to the switching transistor TS.

The capacitor Cst is connected between the gate electrode and the source electrode of the driving transistor TD, and the cathode of the organic light emitting element (OLED) is connected to the voltage ELVSS.

When the scan signal transmitted through the scan line Si is low level, the switching transistor TS is turned on, and the capacitor C is charged by the data signal transmitted through the data lines Dj.

The gate voltage of the driving transistor TD is constantly maintained by the capacitor C for a next scan, and the driving current of the driving transistor TD is generated depending on a difference of the gate-source voltage. The organic light emitting device (OLED) emits light according to the driving current.

According to the present example embodiment, the power source controller 110 outputs a PWM signal controlling the voltage ELVSS among the voltages ELVDD and ELVSS that is a voltage used for light emission of the pixel of the display unit 10.

Also, the power source controller 110 receives the PWM signal from the connection controller 130, and may output the PWM signal to the input and output port 160 through the switching unit 140.

The memory 120 stores an initial setting value for the display driving. The memory 120 may be included in an MTP block portion according to an example embodiment.

According to the present example embodiment, the initial setting value stored to the memory 120 includes a gamma value, a power voltage setting value, panel driving timing, and an I/F setting value.

The driving device 100 writes the initial setting value provided from the connection controller 130 to the memory 120 and then fixes the written initial setting value by using the MTPHV voltage applied from the switching unit 140.

The connection controller 130 generates the various control signals and controls each element of the driving device 100 by the control signals.

The connection controller 130 controls the operation of the switching unit 140 and controls the operation of the switching unit 140 according to the operation state of writing the data to the memory 120 and driving the display, etc.

Also, the connection controller 130 receives the various signals from a register 150. The initial setting value for the display driving may be provided to the memory 120 when writing the data to the memory 120, and the PWM signal to control the external DC-DC converter may be provided to the power source controller 110 when driving the display.

The switching unit 140 connects the power source controller 110 or the memory 120 to the input and output port 160 according to the control of the connection controller 130.

For example, the switching unit 140 connects the memory 120 and the input and output port 160 when writing the data to the memory 120, and connects the power source controller 110 and the input and output port 160 when driving the display.

According to the present example embodiment, the PWM signal of the power source controller 110 may be output through the input and output port 160 to control the external DC-DC converter when connecting the power source controller 110 and the input and output port 160.

Further, the MTPHV voltage provided from the outside is applied to the memory 120 to write to or delete the data from the memory 120 when connecting the memory 120 and the input and output port 160.

According to the present example embodiment, the switching unit 140 connects the power source controller 110 and the memory 120 to the input and output port 160 through one wire 170.

Accordingly, since the driving device 100 controls the DC-DC converter 50 and simultaneously applies the voltage to the memory 120 through one wire 170, the area of the driving device 100 and the number of pins may be reduced.

Figure 5:
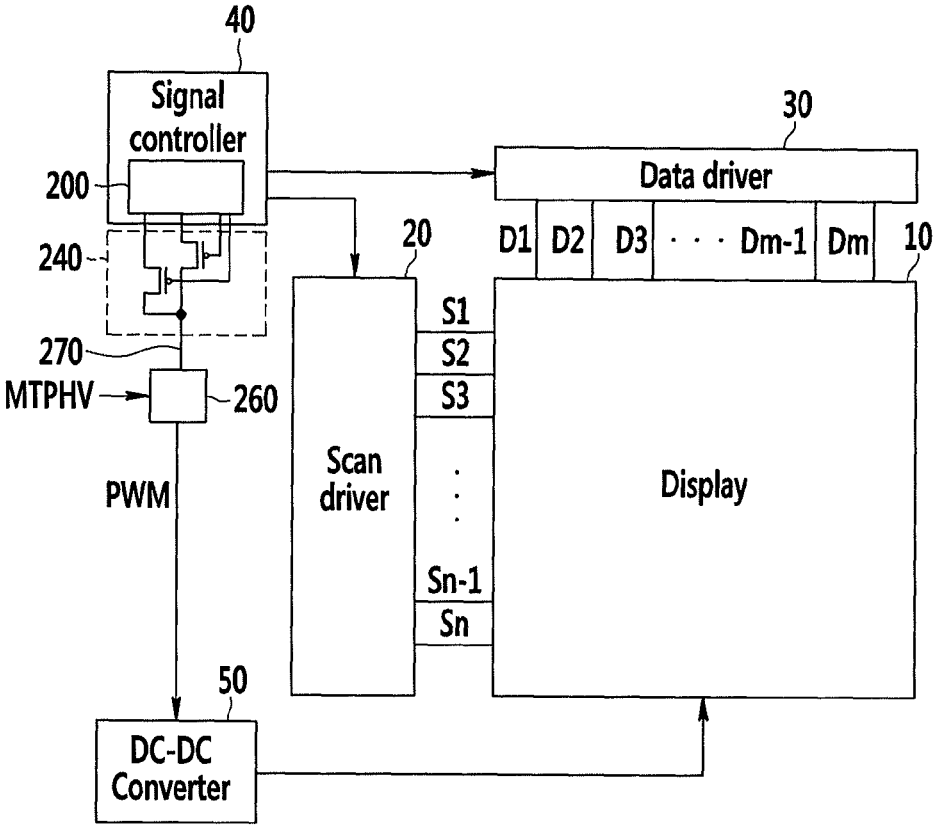
FIG. 5 is a view of a display device including a driving device according to another example embodiment.

FIG. 5 is a view of a display device including a driving device according to another example embodiment.

Referring to FIG. 5, the display device includes the display unit 10, the scan driver 20, the data driver 30, the signal controller 40, the DC-DC converter 50, and an input and output port 260. Here, the display unit 10, the scan driver 20, the data driver 30, and the DC-DC converter 50 are the same as that shown in FIG. 1 such that the description thereof is omitted.

The signal controller 40 includes a driving device 200. The driving device 200 receives the MTPHV voltage to fix the data written to the memory, and provides the PWM signal controlling the power supplied to the display to the DC-DC converter 50.

A switching unit 240 is disposed between the driving device 200 and the input and output port 260 of the signal controller 40. Also, the switching unit 240 and the input and output port 260 receive the MTPHV voltage and provide the PWM signal through one wire 270.

Figure 6:
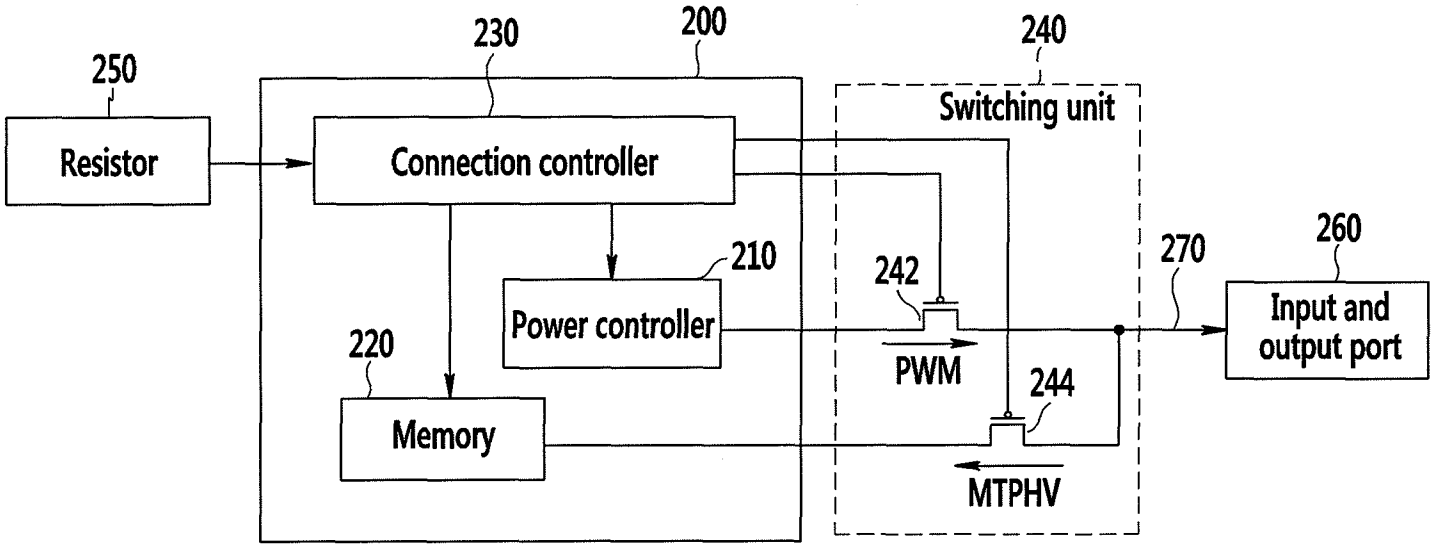
FIG. 6 is a block diagram of a portion of a display device according to another example embodiment.

FIG. 6 is a block diagram of a portion of a display device according to another example embodiment.

Referring to FIG. 6, the display device includes the driving device 200, the switching unit 240, a register 250, and the input and output port 260.

The driving device 200 outputs the control signal controlling the display device, and includes a power source controller 210, a memory 220, and a connection controller 230 according to an example embodiment.

Here, the power source controller 210 and the memory 220 are the same as the power source controller 110 and the memory 120 of FIG. 3 such that the detailed description thereof is omitted.

The switching unit 240 connects the power source controller 210 or the memory 220 to the input and output port 260 according to the control of the connection controller 230.

The switching unit 240 includes a first switching transistor 242 and a second switching transistor 244 realized on the panel according to an example embodiment, as shown in FIG. 4.

The first switching transistor 242 and the second switching transistor 244 are formed on the panel, and may be realized by a CMOS transistor, e.g., a PMOS transistor or an NMOS transistor. The operation state that is realized by the PMOS transistor will now be described.

The first switching transistor 242 includes the gate connected to the connection controller 210, the source connected to the power source controller 210, and the drain connected to the input and output port 260.

The first switching transistor 242 outputs the PWM signal of the power source controller 210 to the input and output port 260 according to the control of the connection controller 230.

Also, the second switching transistor 244 includes the gate connected to the connection controller 210, the source connected to the input and output port 260, and the drain connected to the memory 220.

The second switching transistor 244 applies the external voltage MTPHV to the memory 220 according to the control of the connection controller 230.

Thus, the connection controller 230 applies the VGH voltage OFF to the gate of the first switching transistor 242 and the VGL voltage ON to the gate of the second switching transistor 244 when writing the data to the memory 220.

When writing the data to the memory 220, after the initial setting value for driving the display is written to the memory 220, the MTPHV voltage is applied through the second switching transistor 244 thereby fixing the initial setting value.

Also, when driving the display, the connection controller 230 applies the VGL voltage ON to the gate of the first switching transistor 242 and the VGH voltage OFF to the gate of the second switching transistor 244.

Accordingly, when driving the display driving, the power source controller 210 may output the PWM signal to the input and output port 260 through the first switching transistor 242.

The driving method includes a controlling operation, a switching operation, and a driving operation.

In the controlling operation, the connection controllers 130 and 230 write the data to the memories 120 and 220 or output the control signal according to the operation state driving the display of the display device to control the switching units 140 and 240.

In the switching operation, according to the control signal of the connection controllers 130 and 230, the switching units 140 and 240 connect the memories 120 and 220 or the power source controllers 110 and 210 to the input and output ports 160 and 260.

Also, in the driving operation, according to the connection state of the switching units 140 and 240, the voltage is applied to the memories 120 and 220, or the signal of the power source controllers 110 and 210 is output to the input and output ports 160 and 260.

In the driving operation, if the memories 120 and 220 are connected to the input and output ports 160 and 260, to fix the initial setting value that is written to the memories 120 and 220 or is deleted, the external MTPHV voltage is applied to the memories 120 and 220 through the input and output ports 160 and 260 and the switching units 140 and 240.

Also, in the driving operation, if the power source controllers 110 and 210 are connected to the input and output ports 160 and 260, the PWM signal controlling the DC-DC converter is output to the input and output ports 160 and 260. At this time, the power source controllers 110 and 210 output the PWM signal controlling the ELVSS voltage.

Accordingly, the present example embodiment applies the external voltage to the memories 120 and 220 or the signal of the power source controllers 110 and 210 to the outside through one of the wires 170 and 270. Thus, general separated circuits may be combined into one, thereby reducing the area of the driving device and the number of pins.

Also, the present example embodiment adds the GND wire by the reduction of the number of connector pins and deletes the MTPHV wire of the floating state when driving the module, thereby helping to enhance the EMI characteristic. Further, the present example embodiment may realize the ESD preventing circuits, which are generally separately formed, into one circuit.

Embodiments may also be implemented by a program realizing functions corresponding to the construction of the example embodiments, and a recording medium on which the program is recorded, in addition to the device and method described above.

By way of summation and review, a display device may have different information written to an MTP memory according to a characteristic. The MTP memory may be included in a driving integrated circuit D-IC of the display device, and an MTPHV voltage is supplied to the MTP memory to write new information to the MTP memory. Also, a separate pin or wire to transmit the MTPHV voltage to the MTP memory is allocated in a general driving integrated circuit.

As described above, embodiments may provide a device and a method for applying a MTPHV voltage to a driving device through one wire. According to embodiments, by applying the voltage to the driving device and controlling the DC-DC converter through one wire, the area of the driving device and the number of pins may be reduced. Also, embodiments may realize separate circuits through one circuit to help enhance the EMI characteristic, and the ESD preventing circuits that are respectively formed as separate circuits may be realized through one.

<Description of Symbols>

| | | |
|---|---|---|
| 10: display unit | 20: scan driver | 30: data driver |
| 40: signal controller | 50: DC-DC converter | 100, 200: driving device |
| 110, 210: power source controller | | 120, 220: memory |
| 130, 230: connection controller | | 140, 240: switching unit |
| 150, 250: register | | 160, 260: input and output port |
| 170, 270: wire | | 242: first switching transistor |
| 244: second switching transistor | | |

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A driving device, comprising:

a memory configured to store an initial setting value to drive a display;

a power source controller configured to output a pulse width modulation (PWM) signal controlling power applied to the display; and a switching unit configured to connect an input and output port to the memory when writing data to the memory and configured to connect the power source controller to the input and output port when driving the display.

2. The driving device as claimed in claim 1, wherein the switching unit is configured to connect the memory and the power source controller to the input and output port through one wire.

3. The driving device as claimed in claim 1, further comprising a connection controller configured to control the switching unit, wherein the connection controller is configured to provide the initial setting value to the memory when writing the data to the memory and provide the PWM signal to the power source controller when driving the display.

4. The driving device as claimed in claim 3, wherein the memory is configured to fix the initial setting value written thereto by using a voltage applied from the switching unit after writing the initial setting value provided from the connection controller.

5. The driving device as claimed in claim 3, wherein the power source controller is configured to output the PWM signal provided from the connection controller to the input and output port through the switching unit.

6. The driving device as claimed in claim 5, wherein the PWM signal output by the power source controller controls an ELVSS voltage.

7. A display device comprising the driving device as claimed in claim 1.

8. A driving device, comprising:

a driving device including a memory configured to store an initial setting value to drive a display and a power source controller configured to output a pulse width modulation (PWM) signal controlling a power source voltage supplied to the display; and a switching unit configured to connect an input and output port to the memory when writing data to the memory and connect the power source controller to the input and output port when driving the display.

9. The display device as claimed in claim 8, wherein the driving device further includes a connection controller configured to control the switching unit according to an operation state of writing the data to the memory and driving the display.

10. The display device as claimed in claim 9, wherein:

the switching unit includes a first switching transistor configured to connect to the memory and configured to apply an MTPHV voltage to the memory, and a second switching transistor configured to connect to the power source controller and output the PWM signal of the power source controller to control a DC-DC converter.

11. The display device as claimed in claim 10, wherein the connection controller is configured to apply a VGL voltage ON to a gate of the first switching transistor, apply the MTPHV voltage to the memory, and apply a VGH voltage OFF to a gate of the second switching transistor when writing the data to the memory.

12. The display device as claimed in claim 10, wherein the connection controller is configured to apply the VGH voltage OFF to the gate of the first switching transistor and apply the VGL voltage ON to the gate of the second switching transistor to output the PWM signal of the power source controller to the input and output port when driving the display.

13. A method of driving a display device by a driving device, the method comprising:

a controlling operation of outputting a control signal according to an operation state of writing data to a memory and driving a display;

a switching operation of connecting the memory or a power source controller to an input and output port by a switching unit according to the control signal; and a driving operation of applying a voltage to the memory or outputting a signal of the power source controller to the input and output port according to the switching operation.

14. The method as claimed in claim 13, wherein, in the driving operation, if the memory is connected to the input and output port, an MTPHV voltage is applied to the memory to fix an initial setting value that is written to the memory.

15. The method as claimed in claim 13, wherein, in the driving operation, if the power source controller is connected to the input and output port, a PWM signal controlling a DC-DC converter is output to the input and output port.

16. The method as claimed in claim 13, wherein, in the driving operation, the MTPHV voltage is applied to the memory or the PWM signal of the power source controller is output through one wire.

* * * * *